United States Patent [19]

Sanz

[11] Patent Number: 4,588,022

[45] Date of Patent: May 13, 1986

[54] ANODIC PROTECTION SYSTEM AND METHOD

[75] Inventor: Delio Sanz, Willowdale, Canada

[73] Assignee: C-I-L Inc., Willowdale, Canada

[21] Appl. No.: 597,806

[22] Filed: Dec. 14, 1983

Related U.S. Application Data

[63] Continuation of Ser. No. 445,999, Dec. 1, 1982, abandoned.

[30] Foreign Application Priority Data

Jan. 21, 1982 [CA] Canada ..... 394576

[51] Int. Cl.[4] ..... F28F 19/00

[52] U.S. Cl. ..... 165/1; 165/134.1; 204/147; 204/196

[58] Field of Search ..... 165/1, 134 R; 204/147, 204/196

[56] References Cited

U.S. PATENT DOCUMENTS 1,020,480 3/1912 Cumberland ..... 165/134 R

FOREIGN PATENT DOCUMENTS 18124 10/1980 European Pat. Off. ..... 204/196
441529 5/1926 Fed. Rep. of Germany ... 165/134 R
2244331 3/1974 Fed. Rep. of Germany ... 165/134 R
54-97864 8/1979 Japan ..... 165/134 R

*Primary Examiner*—Sheldon J. Richter
*Attorney, Agent, or Firm*—Rogers, Bereskin & Parr

[57] ABSTRACT

An anodic protection system particularly useful in heat exchangers for cooling sulphuric acid, in which the cathode projects through both ends of the heat exchanger and a negative potential is applied to both ends of the cathode. The potentials are controlled to ensure that the hot and cool ends of the heat exchanger metal (tubes and shell) which ends have different potential requirements for remaining in the passive range, both remain within their respective passive ranges.

11 Claims, 9 Drawing Figures

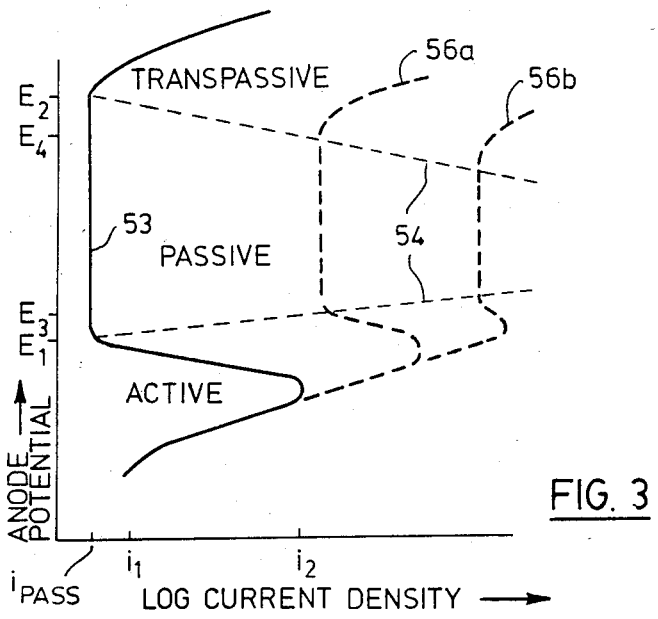
FIG. 3
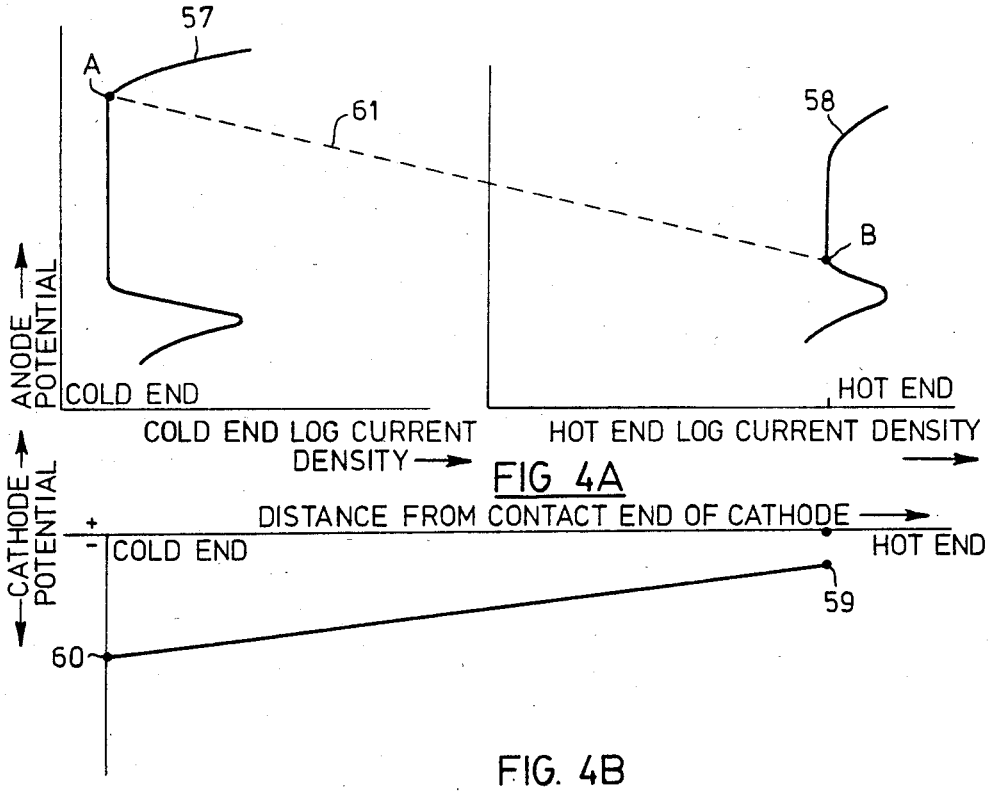
FIG 4A
FIG. 4B

ANODIC PROTECTION SYSTEM AND METHOD

This application is a continuation of application Ser. No. 06/445,999 filed Dec. 1, 1982, now abandoned.

This invention relates to an anodic protection system capable of providing improved protection in three dimensions.

Electrical currents have been used industrially for many years to protect against metal corrosion, either by making the metal noble (cathodic protection) or more recently by the creation of a protective anodic film, in which case the technique is known as anodic protection. This invention is concerned with improved anodic protection. The invention has particular advantage as applied to heat transfer equipment, such as shell and tube heat exchangers used to cool a corrosive fluid, where the corrosive fluid passes around the heat exchanger tubing while water passes through the tubes to cool the fluid circulating outside the tubes, i.e. where the corrosive fluid is on the shell side of the heat exchanger.

Anodic protection is usually provided for such heat exchangers by providing cathodes which extend into the heat exchangers from one end thereof. The cathodes (which may number from one to three or more) are supplied with a current intended to maintain the metal of the heat exchanger in a passive potential range where corrosion is low (as will be explained shortly). However, the heat exchangers are commonly very long, are often very hot at one end and relatively cool at the other end, and may contain an aggressive acid such as sulphuric acid. Under these circumstances, the potential at the cathode required to maintain the heat exchanger metal in a passive potential range may vary from one end of the heat exchanger to the other. With present techniques and presently available cathode materials, it is often difficult to maintain the metal of the heat exchanger in the required passive potential range along the full length of the heat exchanger. Because the passive potential range at the hot end of the heat exchanger is narrower than that at the cold end, and because of the potential drop in a long cathode, the conditions may be such that the tubes at the colder end may reach a potential in the transpassive range in order that the potential of the tubes at the hot end is brought into the passive range. This can result in rapid corrosion of these portions of the tubes which are in the transpassive range, drastically reducing the life expectancy of the heat exchanger.

It is therefore an object of the invention to provide an improved method and apparatus for anodic protection, which offers improved capability for maintaining the metal to be protected in the required passive potential range over the full length of the structure to be protected. To this end the invention in one of its aspects provides in a metal structure to be anodically protected, an improved anodic protection system comprising: cathode means extending through said structure and having a pair of ends, said cathode means being of a material having substantial electrical resistance, connection means at each said end of said cathode means, and means for applying a negative potential to each connection means, whereby to provide a selected potential at each end of said cathode means, and to maintain the potential of said structure in the passive potential range along the length of said structure.

In another aspect the invention provides a method of anodically protecting a metal structure having cathode means extending along its length, comprising controlling the potential along said cathode means by applying a negative potential to each end thereof and controlling said potentials, to maintain the potential of said structure in the passive potential range along the entire length of said structure.

Further objects and advantages of the invention will appear from the following description, taken together with the accompanying drawings in which:

FIG. 3 is a graph showing the active, passive and transpassive ranges for anodic protection;

FIG. 4A is a graph showing polarization curves for the cold and hot ends of the FIG. 1 heat exchanger;

FIG. 4B is a graph showing the potential along the length of the cathode required to achieve potentials shown in FIG. 4A;

Figure 1:
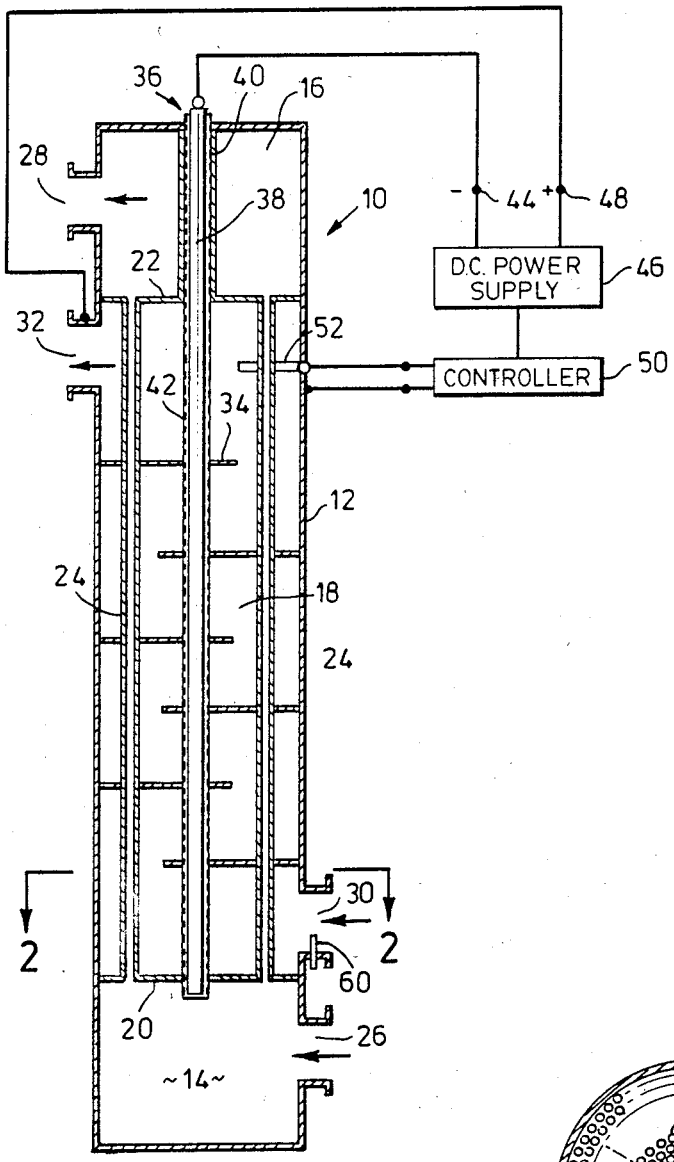
FIG. 1 (PRIOR ART)
FIG. 1 is a schematic view showing a prior art heat exchanger with an anodic protection system installed therein.
Figure 2:
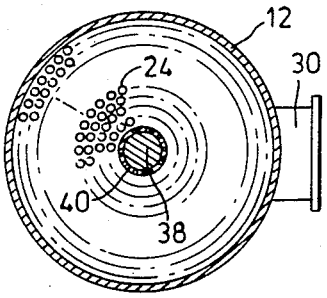
FIG. 2 (PRIOR ART)
FIG. 2 is a sectional view taken along lines 2—2 of FIG. 1.

Reference is first made to FIG. 1, which shows diagrammatically a typical prior art heat exchanger 10 of the kind presently in commercial use. The heat exchanger 10 includes an outer shell 12 divided into a water inlet box 14, a water outlet box 16, and a cooling section 18, the three sections being separated by tube sheets 20, 22. Heat exchanger tubes 24 extend between the tube sheets to carry water therebetween. Only two tubes 24 are shown in FIG. 1, but in practice and as indicated in FIG. 2, there may be more than 1,000 of the tubes 24, packed very closely together with small clearances (typically 0.25 to 0.5 inches) therebetween. Cooling water enters the water inlet box 14 via inlet 26, flows through the tubes 24, and exits from the water outlet box 16 via outlet 28. Hot acid enters the cooling section 18 via an acid inlet 30 and leaves via an acid outlet 32. Conventional baffles 34 are provided to ensure that the acid flows through a tortuous path in the cooling section 18 for maximum cooling.

Heat exchangers of the kind shown are commonly used for cooling acids such as hot sulphuric acids during the manufacture of the acid. The shell, tube sheets and tubes are commonly made of standard grades of austenitic steels, which in the absence of electrical protection will corrode at an unacceptably rapid rate in the presence of hot sulphuric acid. An anodic protection system will reduce this rate of corrosion.

The conventional anodic protection system shown in FIGS. 1 and 2 includes an elongated cathode 36, typically thirty feet or more in length, which is inserted into the heat exchanger 10 from one end thereof. The cathode 36 consists of a central core 38 of relatively acid resistant alloy, such as that available commercially under the name Hastelloy C276 (trade mark), surrounded by an insulating sheath 40 of material such as polytetrafluoroethylene perforated with numerous holes 42 to allow the acid in the cooling section to contact the metallic cathode core 38. The sheath 40 prevents grounding of the cathode core 38 on the metal parts of the heat exchanger and avoids transpassivity on baffles and tube sheets in close proximity to the cathode. The cathode 36 is supplied with current from the negative terminal 44 of a DC power supply 46, the positive terminal 48 being connected directly to the shell 12. The power supply 46 is controlled by an automatic controller 50 which in turn is controlled by the potential derived from a reference electrode 52.

The success of the conventional anodic protection system shown will be understood with reference to the exemplary polarization curve 53 shown in FIG. 3 for metals such as stainless steel in sulphuric acid. FIG. 3 shows on the vertical axis the positive potential of the metal being protected, and on the horizontal axis the log of current density. As shown in FIG. 3, it is found that when the anodic potential is increased, the measured current density (and hence the rate of corrosion) at first increased from $i_1$ to $i_2$. However, as the potential continues to increase, the current density decreases and drops to a very low value $i_{pass.}$ (the passive current density) and remains at a low value over a range of potentials indicated as $E_1$ to $E_2$. The range of potentials over which the current remains at a low value is termed the passive potential range. In this range the metal is covered by a protective oxide film. Corrosion rates in this passive range are usually very low. The potential range below the passive range is referred to as the active range, and there the corrosion rate is significantly higher.

As the potential is increased beyond the passive range, the current density again begins to increase and corrosion increases. This is called the transpassive range. It is important that the potential reached by the metal be kept below the transpassive range but above the active range.

As the temperature of the metal being protected increases, the passive potential range becomes narrower and is displaced outwardly (i.e. the passive current density $i_{pass.}$ increases). The narrowed range is shown by converging dotted lines 54 and typical polarization curves under these conditions are shown at **56*a* and 56*b*. It will be seen that the passive potential range $E_3$ to $E_4$ for curve 56*a* is smaller than the range $E_1$ to $E_2$. In addition, differing temperatures can displace the passive range $E_3$ to $E_4$ upwardly or downwardly along the vertical axis in FIG. 3**.

In a long heat exchanger such as that shown in FIG. 1, the above noted factors can produce severe difficulty. In such heat exchangers there is often a considerable temperature difference between metal of the tubes and shell at the hot end and at the cold end of the exchanger. In addition the cathode, when formed from a material which will resist acid attack, has considerable internal resistance. (For example the resistivity of the Hastelloy C alloy is 1.30 microhm-meters, which is about 80 times greater than that of copper.) Since a long cathode is usually required, there is a considerable potential drop along the length of the cathode when the current demand is high.

The consequences of this situation are shown in FIGS. 4A and 4B. FIG. 4A shows the polarization curve 57 for the metal being protected (i.e. the heat exchanger tubes) at the hot end of the exchanger, and the corresponding curve 58 for the metal being protected at the cold end of the exchanger. FIG. 4B shows at 59 the potential which must be present on the cathode at the hot end of the exchanger to achieve anodic potential B on the metal of the tubes at the hot end. Because of the internal resistance of the cathode, a relatively high negative potential 60 must be applied at its contact end (shown as being at the cold end of the exchanger) in order to achieve anodic potential B at the hot end. The high negative potential at the contact end of the cathode produces a higher anodic potential A on the metal being protected at the cold end of the exchanger. The variation in anodic potential of such metal between the cold and hot ends of the exchanger is shown by curve 61 in FIG. 4A.

If the heat exchanger is operated in a mode such that the metal temperature of the tubes is relatively high, then the passivation current required increases, increasing the potential drop along the cathode. This has the result that to achieve potential B in FIG. 4A, the potential applied to the contact end of the cathode may be such as to move the potential of the tubes at the cold end of the exchanger, particularly those near the cathode, into the transpassive range. The corrosion then rapidly increases. Conversely, if the potential of the tubes at the cold end is kept in the passive range, the potential of the tubes at the hot end may move into the active range, again rapidly increasing corrosion rates.

It may be observed that a current density of 0.1 milliamperes per square inch corresponds to a nominal corrosion rate, i.e. a rate of loss of metal, of about 0.005 inches per year. At this rate one half of a tube wall of 0.060 inches thickness would vanish in 6 years. The usual predictable life of a tube is calculated as the time for its wall to reach half of its original thickness. When the potential of the tubes moves out of the passive range, as can easily occur when the metal temperature is high, the tubes can be perforated in a very short time.

Attempts have been made to solve the problem by inserting additional cathodes, called pin cathodes, in localized positions such as in the vicinity of the acid inlet, as shown at 60 in FIG. 1. However, the pin cathodes only provide localized protection.

The applicant has used a cathode with a copper core sheathed with corrosion resistant material as well as a cathode of solid corrosion resistant material. The copper core cathode was designed to provide a more uniform potential along its length, but it has the disadvantage that the potentials at each end of the cathode cannot be separately controlled.

Figure 5:
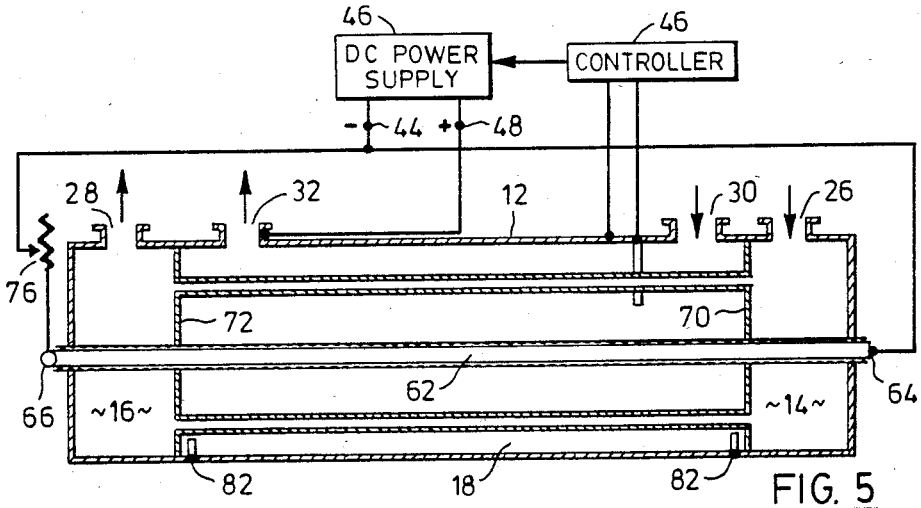
FIG. 5 is a schematic sectional view showing an improved anodic protection system according to the invention.

Reference is next made to FIG. 5, which shows an arrangement according to the invention for providing better control over the potential applied to the cathode along its length and for improving the ability of the system to maintain the metal of the heat exchanger in the passive potential range along the length of the heat exchanger. As shown in FIG. 5, a cathode 62 is provided, extending completely through the heat exchanger, through both the water inlet box 14 and the water outlet box 16. Connections are made from both ends 64, 66 of the cathode to the negative terminal 44 of the DC power supply 46. A positive connection is made as before from the positive terminal 48 of the power supply to the shell 12 of the heat exchanger. Although extending the cathode 62 through both ends of the heat exchanger involves added cost, significant advantages result, as will now be described.

Figure 6:
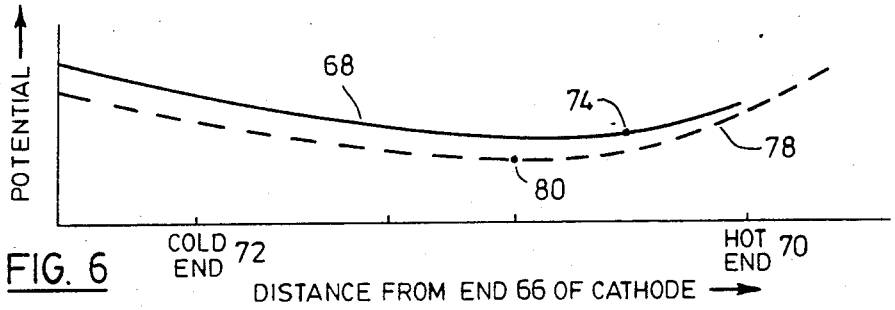
FIG. 6 is a graph showing the potential along the length of the cathode of the FIG. 5 system.

The potential curve along the cathode 62 is now as shown by curve 68 in FIG. 6. The potential is a maximum at each end of the cathode, due to the resistance drop along the length of the cathode. However, the difference between the maximum and minimum potentials is much reduced, thereby reducing the likelihood that the applied potential will be such as to drive the anodic current outside the passive range.

Since the acid at the hot end 70 of the cooling section 18 causes more anodic current to be drawn there than at the cool end 72 of the cooling section, the curve 68 is shown as falling more rapidly at the hot end 70 than at the cool end 72 of the cooling section 18. Therefore, the point 74 of minimum potential (the "null point") is closer to the hot end 70 than to the cool end 72 of the cooling section 18. It will usually be desired to control the location of the null point 74 and to move it closer to the center of the heat exchanger, or even closer to the cool end 72 for minimum corrosion. For this purpose, potential controlling means such as a variable resistor can be inserted into the circuit between one or both ends of the cathode 62 and the negative terminal 44 of the DC power supply 46. One such variable resistor 76 is shown in FIG. 5, inserted in series between the end 66 of the cathode (at the cold end of the exchanger) and the power supply. The use of resistor 76 will modify the potential curve 68 of FIG. 6 to that shown in dotted lines at 78 and will move the null point closer to the cold end as indicated at 80. By using monitor reference electrodes 82 adjacent each end of the heat exchanger to observe the potentials present, the curve 78 can be adjusted for minimum corrosion in any given system taking into account the specific corrosive process fluid or electrolyte in use.

It may also be noted that cathode materials are expensive. The invention has the advantage of reducing the amount of cathode material needed, since a single cathode can carry more current when fed from both ends, thus reducing the number of cathodes needed or the cross section of the individual cathodes if the number if left unchanged.

Figure 7:
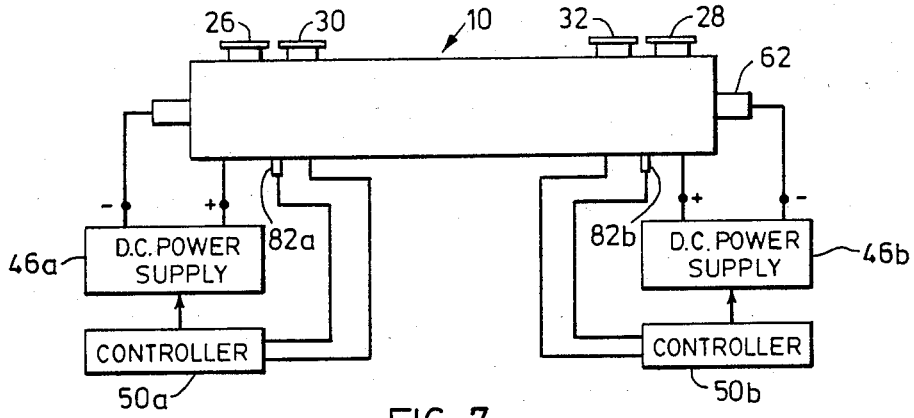
FIG. 7 shows a modification of the FIG. 5 system.

The variable resistor 76 is shown to enable control of the potentials at each end of the cathode and will normally use only a relatively small amount of power. However, where high temperatures and narrow passive ranges exist, automatic control can be provided at each end if desired. Such an arrangement is shown in FIG. 7, where two controllers 50*a*, 50*b* are shown as controlling two DC power supplies 46*a*, 46*b*, one connected to each end of the cathode rod 62. Each controller 50*a*, 50*b* is controlled by a separate reference electrode 82*a*, 82*b* respectively, to ensure that the potentials at each end of the cathode are within the required passive range.

Figure 8:
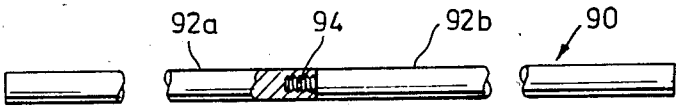
FIG. 8 shows a modified cathode according to the invention.

Although the cathode 62 has been shown as a single rod, it can if desired be fabricated as shown at 90 in FIG. 8. Electrode 90 consists of two rods 92*a*, 92*b* of normal electrode material as previously described, joined by an axial threaded projection 94 from rod 92*b* which is screwed into a corresponding threaded recess in the end of rod 92*a*. The threaded fit can alternatively be a press fit or even simply a sliding fit.

Although the heat exchanger shown has been described as a cooler for the corrosive fluid, it could equally well function as a heater for the corrosive fluid.

Although the cathode has been described as being of solid corrosion resistant material, it could in some applications be formed with a core of a suitably electrically resistive material sheathed in corrosion resistant material. A suitable material for the core is ordinary carbon steel, which has sufficient electrical resistance so that the potential at each end of the cathode can be independently controlled. It is extremely desirable that the potential at each end of the cathode be independently controllable, since a difference of as little as 120 millivolts (in some cases) on one end of the cathode can make the difference between low and rapid rates of corrosion. A mechanically suitable copper core has too low a resistance for this purpose.

Thus, in one embodiment the cathode means comprises a composite cathode having a core material having a specific resistance in the range from 0.03 to 0.60 micro-ohm meters.

The more effective anodic protection system described may be used in tanks and vessels other than heat exchangers, but it alleviates a particularly severe problem in heat exchangers used to exchange heat with a corrosive fluid located in the shell space.

What is claimed is:

1. A method of anodically protecting a heat exchanger for a corrosive fluid, said heat exchanger being of the kind having an elongated shell, a plurality of tubes within said shell, baffles within said shell, said corrosive fluid circulating in a tortuous path within said shell over the exterior of said tubes, power supply means for supplying a positive potential, means for connecting said positive potential to said shell, and a cathode extending longitudinally as one continuous cathode entirely through said shell and having a pair of ends, said method comprising controlling the potential along said cathode by applying a first negative potential to one end thereof and applying a second negative potential which is different from said first negative potential to the other end thereof to control the location along the length of said cathode of the minimum negative potential on said cathode, whereby to maintain the potential on the exterior surfaces of said tubes in the passive potential range along the length of said tubes.

2. A method according to claim 1 wherein said structure is used to exchange heat between an acid stream and a cooling medium.

3. A method according to claim 2 wherein said acid is sulphuric acid.

4. In a heat exchanger for a corrosive fluid, said heat exchanger having an elongated shell, a plurality of elongated tubes extending longitudinally within said shell, said corrosive fluid being located between said shell and the exterior surfaces of said tubes and a heat exchange fluid flowing within said tubes to exchange heat with said corrosive fluid, and baffle means within said shell to direct the flow of said corrosive fluid in a tortuous path within said shell; an improved anodic protection system for protecting the exterior surfaces of said tubes, said anodic protection system comprising: power supply means for supplying a positive potential, means for connecting said positive potential to said shell, an elongated cathode extending longitudinally as one continuous cathode entirely through said shell and having a pair of ends, said cathode being insulated from said shell and tubes, said cathode being of a material having substantial electrical resistance, connection means at each said end of said cathode, said power supply means including means for applying a first negative potential to one said connection means and means for applying a second negative potential which is different from said first potential to the other of said connection means, and means for controlling said first and second potentials thus to control the location along the length of said cathode of the minimum negative potential on said cathode , whereby to control the potential distribution along said cathode to reduce corrosion of the exterior surfaces of said tubes.

5. A system according to claim 4 wherein the cathode comprises a composite cathode having a core material having a specific resistance in the range from 0.03 to 0.60 micro-ohm meters.

6. A system according to claim 4 wherein said fluid is sulphuric acid.

7. A system according to claim 4 wherein said heat exchanger includes means for providing a hot acid at a first end thereof and colder acid at the second end thereof, and wherein said means for applying a potential includes means for applying a more negative potential to the end of said cathode at said first end than to the end of said cathode at said second end.

8. A system according to claim 7 wherein said acid is sulphuric acid.

9. A system according to claim 4 wherein said cathode comprises a unitary metal rod extending between said ends.

10. A system according to claim 9 wherein said rod includes a mechanical joint therein.

11. A system according to claim 4 wherein said heat exchanger includes an inlet box at one end of said shell for admitting a heat exchange fluid to be directed into said tubes, and an outlet box at the other end of said shell for receiving heat exchange fluid from said tubes, said cathode extending entirely through said inlet and outlet boxes.

* * * * *